United States Patent [19]

Maloblocki

[11] 4,307,525

[45] Dec. 29, 1981

[54] PNEUMATIC-HYDRAULIC PUMP DREDGE

[75] Inventor: Richard Maloblocki, Hinsdale, Ill.

[73] Assignee: AMTEC Development Company, Libertyville, Ill.

[21] Appl. No.: 67,156

[22] Filed: Aug. 16, 1979

[51] Int. Cl.[3] ..... E02F 3/88

[52] U.S. Cl. ..... 37/65; 37/59; 417/125; 417/138

[58] Field of Search ..... 37/59, 58, 71, 64, 72, 37/65; 175/103, 100, 102; 417/120, 122, 123, 124, 125, 149, 138

[56] References Cited

U.S. PATENT DOCUMENTS

| | | | |
|---|---|---|---|
| 209,159 | 10/1878 | Cummings | 37/59 |
| 331,861 | 12/1885 | Bolles | 37/67 |
| 365,140 | 6/1887 | Lynch | 37/67 |
| 403,125 | 5/1889 | Merrill | 417/125 |
| 407,044 | 7/1889 | Von Schmidt | 37/65 |
| 485,880 | 11/1892 | Perry | 417/122 |
| 503,732 | 8/1893 | Bates | 37/58 |
| 545,762 | 9/1895 | Bates | 37/65 |
| 626,491 | 6/1899 | Ford | 37/72 X |
| 634,864 | 10/1899 | Bates | 37/65 |
| 645,660 | 3/1900 | Bell | 37/59 |
| 654,764 | 7/1900 | Schauffleberger | 417/125 |
| 662,210 | 11/1900 | Wheeler | 37/59 |
| 672,247 | 4/1901 | Wheeler et al. | 37/59 |
| 716,173 | 12/1902 | Bates | 37/65 |
| 725,818 | 4/1903 | Bates | 37/67 |
| 934,031 | 9/1909 | Askew | 37/58 |
| 955,301 | 4/1910 | Wray | 417/125 |
| 1,000,713 | 8/1911 | Callow | 37/59 X |
| 1,093,871 | 4/1914 | McIntyre | 417/122 |
| 1,144,406 | 6/1915 | Bartholomew | 37/61 |
| 1,205,114 | 11/1916 | Shaw | 417/122 |
| 1,326,321 | 12/1919 | Callahan | 37/59 X |
| 1,667,219 | 4/1928 | Ream | 37/65 |
| 1,862,260 | 6/1932 | Edmunds | 175/100 |
| 2,370,430 | 2/1945 | Waldeck | 37/67 |
| 2,669,941 | 2/1954 | Stafford | 417/125 |
| 2,857,852 | 10/1958 | Carignani et al. | 417/122 |
| 3,005,417 | 10/1961 | Swaney | 417/138 X |
| 3,319,654 | 5/1967 | Faldi | 137/624.13 |
| 3,495,409 | 2/1970 | Riedemann | 37/58 X |
| 3,552,884 | 1/1971 | Faldi | 417/122 |
| 3,590,501 | 7/1971 | Bodine | 37/58 X |
| 3,624,933 | 12/1971 | Faldi | 37/71 X |
| 3,667,865 | 6/1972 | Faldi | 417/122 |
| 3,693,272 | 9/1972 | Gariel | 37/72 X |
| 3,791,763 | 2/1974 | Faldi | 37/58 X |
| 3,803,856 | 4/1974 | Faldi | 37/63 X |
| 3,842,521 | 10/1974 | Faldi | 37/59 X |
| 3,842,522 | 10/1974 | Holzenberger et al. | 37/59 X |
| 3,871,581 | 3/1975 | Direly | 239/16 |
| 3,881,530 | 5/1975 | Faldi | 141/284 |
| 3,883,269 | 5/1975 | Wolff | 417/122 |
| 3,958,346 | 5/1976 | Faldi | 37/59 |
| 3,994,082 | 11/1976 | Faldi | 37/71 |
| 4,004,357 | 1/1977 | Faldi | 37/71 X |
| 4,083,134 | 4/1978 | Oterdoom | 37/58 |
| 4,140,437 | 2/1979 | Faldi | 417/122 |
| 4,170,079 | 10/1979 | Holekamp | 37/72 X |

OTHER PUBLICATIONS

Nishi, K.; "Dredging of High-Density Sludge Using Oozer Pump;" *Dredging: Environmental Effects & Technology,* Proceedings of WODCON VII, 7/1976.

Joanknecht, L. W. F.; "Results of Tests on Two Cutter Heads, Operating in Sand;" *First International Symposium on Dredging Technology;* pp. F1-1 to F1-20; 9/1975.

Lumbard, D.; "A New Patented Dredging System Operated by Compressed Air;" *Hydrotransport 2 The Second International Conference on the Hydraulic Transport of Solids in Pipes;* 9/1972; pp. K5-53 to K5-60.

Marv, T.; "Oozer Pump", [Oozer (Hedoro) Pump Dredging Barge], Toyo Construction Co.; 1974; Japanese & Translation.

*Primary Examiner*—Edgar S. Burr

*Attorney, Agent, or Firm*—Trexler, Bushnell & Wolters, Ltd.

[57] ABSTRACT

An efficient dredging device is disclosed, which includes a submersible pump having one or more chambers. Each chamber defines an air port through which air can be delivered to and exhausted from the chamber, and a material discharge port for discharging liquid and solid material from the chamber. A check valve is associated with the discharge port to prohibit the return of discharged material to the chamber. A chamber suction port admits liquid and solid material to the chamber, and a check valve prohibits the escape of material from the chamber through the suction port. Air control means are provided for cyclicly exhausting air from the chamber to admit material to the chamber through the suction port, and for delivering air to the chamber so as to discharge material from the chamber through the discharge port. A rotatable cutter member cuts material to be dredged, and pipes connect the cutter to the chamber discharge port. A vacuum system is provided to reduce air pressure inside the chamber to less than one atmosphere so as to permit the dredge pump to work in very shallow water. This vacuum system can include a jet pump connected to a compressed air source. The pump vessel is suspended from a kelly bar, and the kelly bar is engaged by a torque fork to inhibit bar and pump chamber rotation and other movement during pump operation.

12 Claims, 8 Drawing Figures

PNEUMATIC-HYDRAULIC PUMP DREDGE

BACKGROUND OF THE INVENTION

Dredges have been used for many years to remove submerged material from the bottom of lakes, harbors and other water areas. Reasons for engaging in dredging include deepening waterways to facilitate marine navigation, removal of bottom pollutants, recovery of bottom materials which have commercial value, and others.

Many common dredging devices are large, very expensive, and of limited use. For example, many hydraulic and pneumatic dredges will operate efficiently only in deep water, or only when excavating and removing a particular type of bottom material. Clam-shell dredges, crane buckets and other mechanical dredging devices operate efficiently only when excavating other types of bottom material, and can be expensive to operate. Most dredges require extensive ancillary systems to support the dredge, or to carry away the dredged material, or both.

In the past several years, a submergible pneumatic-hydraulic dredge pump has been offered to overcome some of these problems, but it has met with only limited success. Operators have discovered that this pump works only in relatively deep water, and with loose material which need not be aggressively cut or separated from surrounding bottom material. In some situations, pump operation has tended to cause pump movement; this pump movement can be expensive and difficult to control. If pump operations cannot be carefully monitored, the dredging operation can be so inefficient as to cause the pump operator serious financial difficulty.

It is accordingly the general object of this invention to provide a pneumatic-hydraulic pump dredge which can operate efficiently in deep or shallow water, and which can efficiently, precisely excavate a wide variety of materials.

Another object is to provide a pneumatic-hydraulic pump dredge and associated system which permits the pump to be located precisely at a given dredging spot, and permits the pump to be moved with relatively great precision over the area to be dredged. An associated object is to provide such a dredge which will not cause excessive turbidity and pollution in water adjacent the dredging site.

Yet another object is to offer an improved pneumatic-hydraulic pump which can be constructed and operated at relatively low cost, yet which is reliable in service and rugged in design.

Other objects and advantages of the invention will become apparent upon reading the following detailed description and upon reference to the drawings. Throughout the drawings, like reference numerals refer to like parts.

DETAILED DESCRIPTION

While the invention will be described in connection with a preferred embodiment, it will be understood that it is not intended to limit the invention to this embodiment. On the contrary, it is intended to cover all alternatives, modifications and equivalents as may be included within the spirit and scope of the invention as defined by the appended claims.

Figures 1, 7:
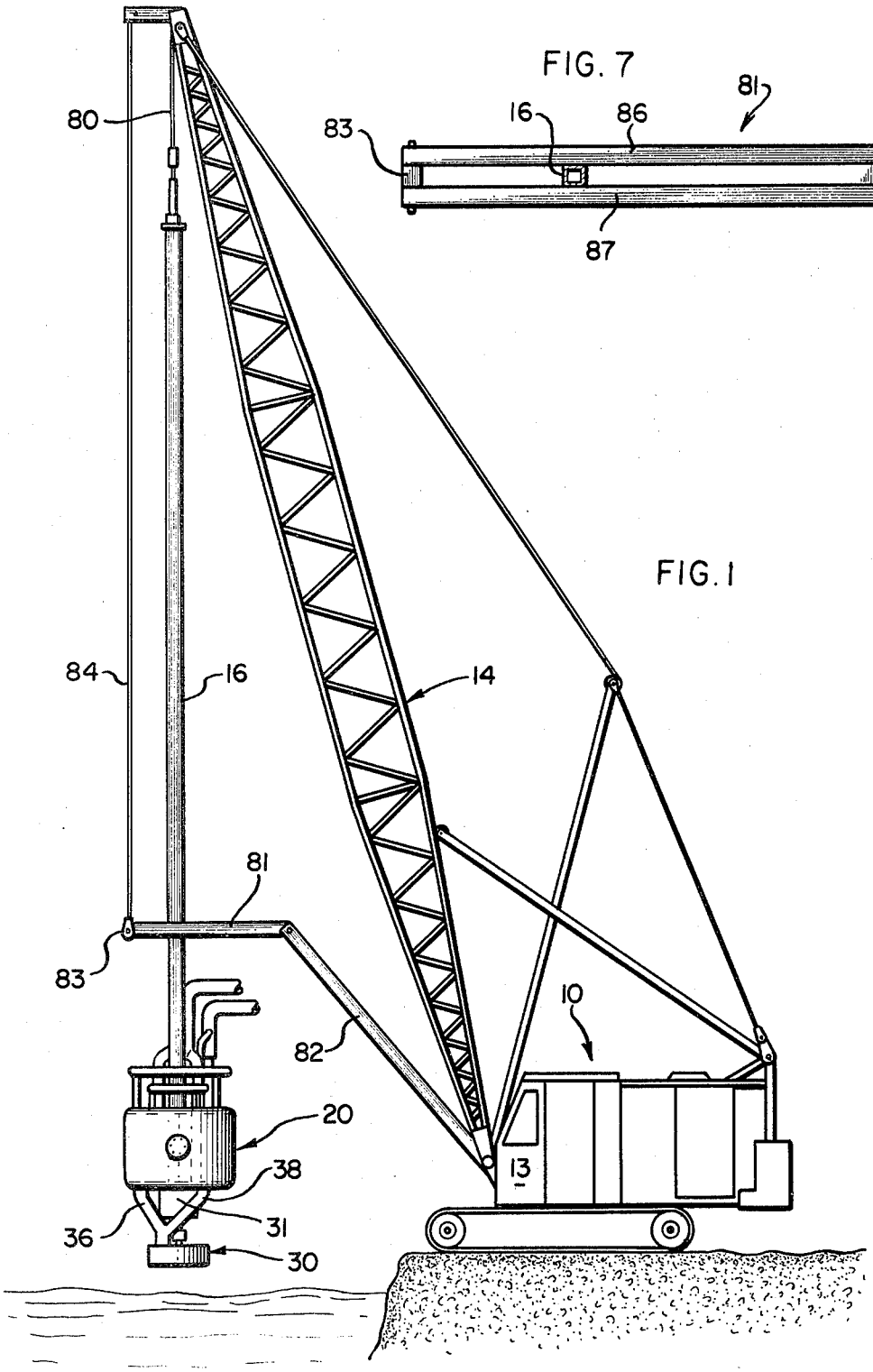
FIG. 1 is a perspective view showing the novel dredge and dredge pump in a typical operating environment.
FIG. 7 is a fragmentary plan view showing in further detail portions of structure used to restrain and guide pump motion.

Turning more specifically to FIG. 1, there is shown an embodiment of the present invention as it might appear when used with a crane 10 adjacent a pier or quay 11 for dredging operations near the quay. In general, the crane 10 includes a power and control cab 13 from which is mounted a boom 14 in the usual manner. Suspended from the boom 14 is a kelly bar 16, an suspended from the kelly bar 16 is a dredge pump 20. By appropriate manipulation of controls for the boom 14 and other crane parts, the dredge operator can precisely locate the dredge pump 20 at a given location for dredging operations. Below the pump 20 is a material cutter 30.

To cut, loosen and otherwise prepare a wide variety of materials to be dredged for further operations in accordance with one aspect of the invention, this cutter 30 is of the crown type, or it can include a number of blade-like vanes. To rotate the cutter 30, a hydraulic or other suitable motor 31 is here mounted between the cutter head 30 and dredge pump vessel 20. Appropriate hydraulic or other power lines 32 energize the motor 31. Cut material is drawn (or in some instances is forced by action of the cutter 30) up large diameter pipes 36, 37 and 38 to the pump 20. This drawing, forcing action provides a surprisingly great synergistic interaction between the efficiency to the pump 20 and cutter 30.

The dredge pump 20 itself is shown in further detail in FIGS. 2–5 and elsewhere. The pump 20 here comprises a single vessel 22 which is internally divided into three pressure-tight chambers 23, 24 and 25 by internal chamber wall plates 26 which are secured in place by weldments or other convenient means. The interior arrangement of each chamber 23, 24 and 25 is identical with the interior arrangement of the other chambers, and pump operations within the chambers are identical, although staggered in time, as described below. Consequently, the interior operation of but a single chamber 23 need be described here.

Cut material flow to the chamber 23 is encouraged by developing a vacuum in the chamber. To accomplish this, air is drawn from the chamber through a vacuum valve, as more fully described below. Material entering the chamber 23 through the pipe 36 is prohibited from escaping backwardly from that chamber 23 through the suction pipe 36. To this end, a suction port check valve 40 is provided to selectively engage a suction port-defining extension pipe 41. The incoming material is, as illustrated, admitted into the chamber 23 at a relatively elevated position.

Dredge material continues to be urged into the chamber 23 through the pipe extension 41 until the chamber is filled to a high level H, and the dredge material reaches a high level sensor switch 27. When the sensor switch 27 is actuated, the vacuum valve is closed, and a compressed air valve opens to pressurize the chamber 23 to a positive pressure. As the compressed air enters the chamber, the dredge material or slurry previously sucked into the chamber 23 is forced out of the chamber through a discharge pipe 45 having a tear-drop shaped entrance 46. Material traveling up this discharge pipe 45 unseats a ball 47 from a ball valve seat 48, travels around the ball 47 and up a discharge wye line 49 to a discharge collector pipe or hose 50. This hose can be routed away from the vessel 22, and to a convenient discharge point. The discharge point can be a lighter, an accumulation pond, or other receiving facility. It will be noted that the material discharge port 46 is located near the bottom 52 of the chamber 23 so as to encourage relatively complete liquid and solid material discharge from the chamber 23. Slurry discharge action continues until the material level in the chamber sinks to a predetermined low level L which is sensed by a low level sensor 53. After the material has been discharged, compressed air introduction is halted, and the vacuum is re-created within the chamber 23. This action also causes the ball 47 to re-engage its seat 48, so as to inhibit return of dredged material to the chamber 23 through the discharge pipe 45 and port 46.

In accordance with one aspect of the invention, the compressed air introduction and vacuum exhaust system permits the dredge to be operated in very shallow water. For example, successful operations can be conducted in a very few feet or even inches of water so that the pump vessel itself need not be entirely submerged. The compressed air and vacuum system is reliable and rugged, yet is inexpensive to construct.

Figure 2:
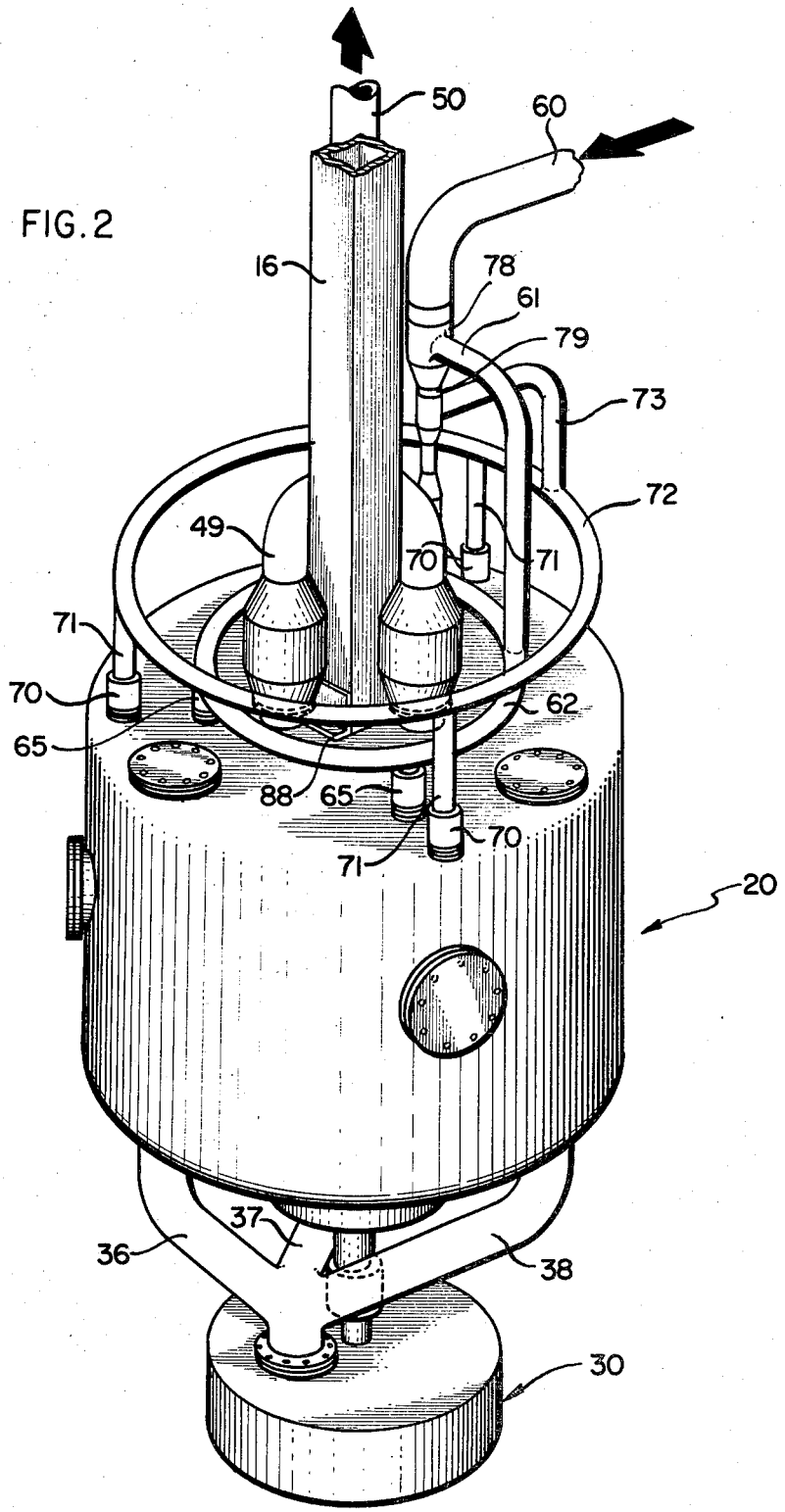
FIG. 2 is a perspective view showing in further detail the dredge pump and associated apparatus.
Figure 3:
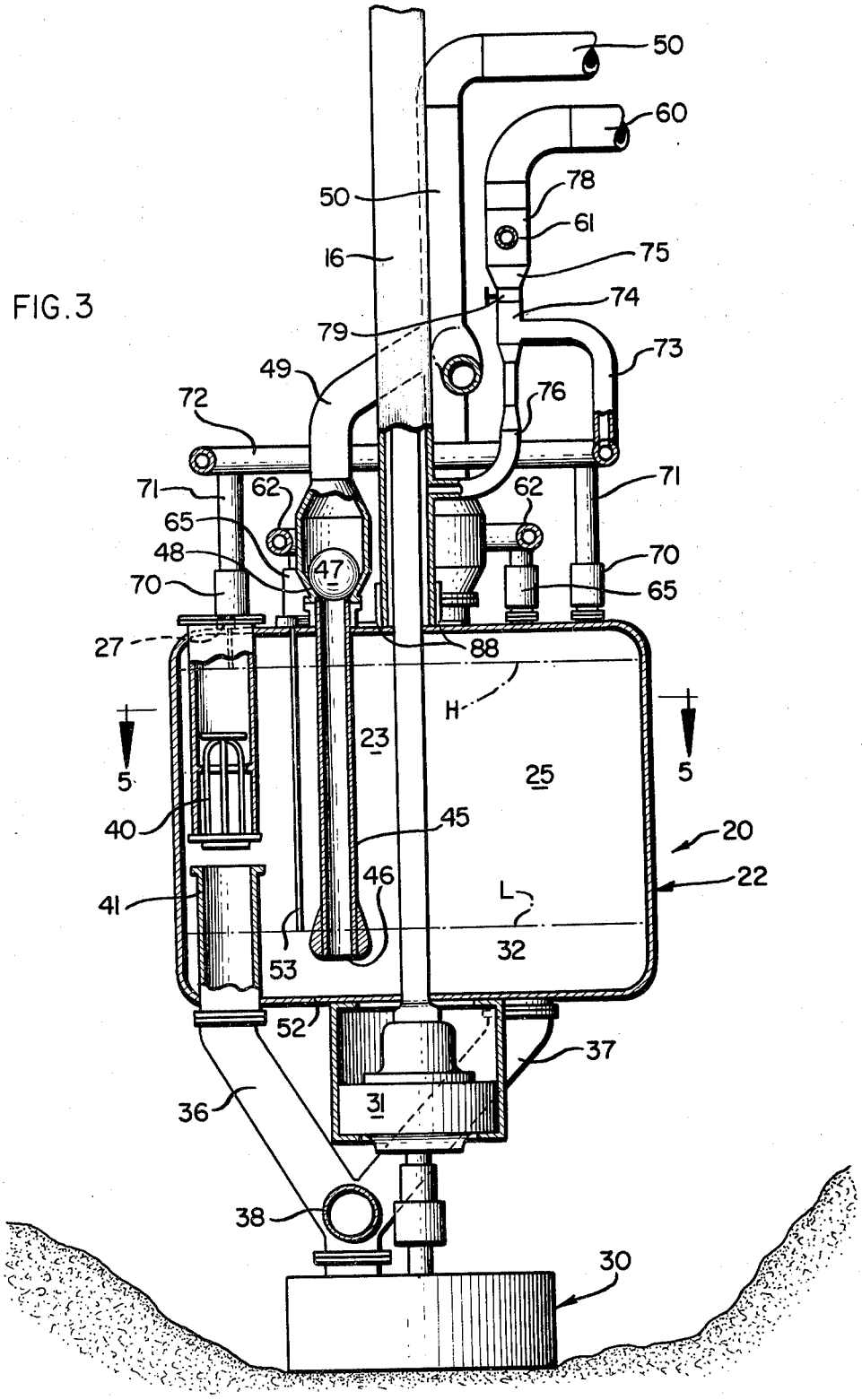
FIG. 3 is an elevational view in partial section showing the interior of the dredge pump and associated apparatus.
Figure 4:
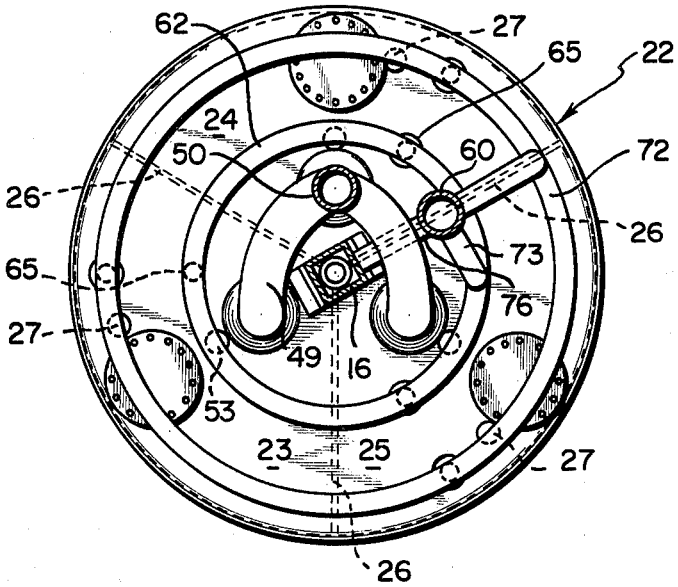
FIG. 4 is a top plan view in partial section showing the dredge pump and associated piping lines.
Figure 6:
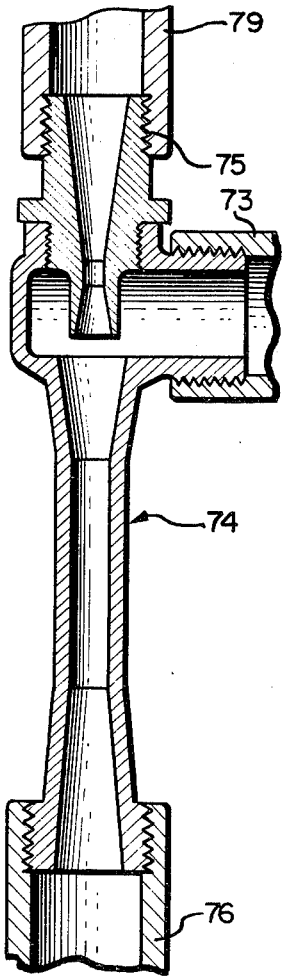
FIG. 6 is a fragmentary elevational view showing, in somewhat schematic format, interconnections between the dredge pump compressed air, vacuum, and exhaust systems at the jet pump.
Figure 5:
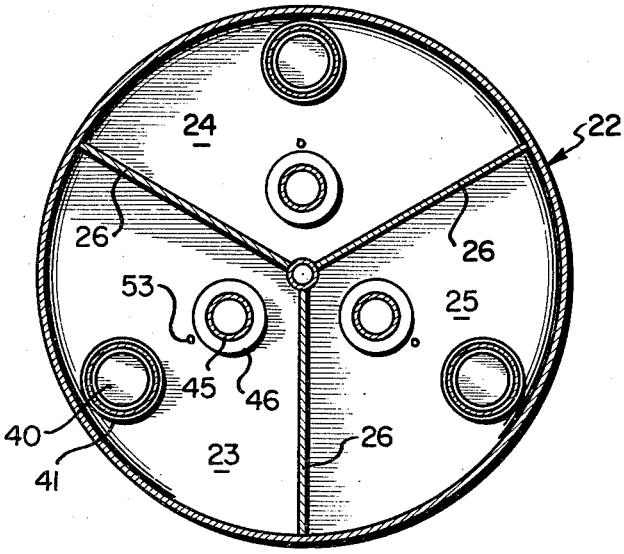
FIG. 5 is a sectional view showing the dredge pump vessel in further detail.

To introduce compressed air into the chambers 23, 24 and 25 in accordance with this aspect of the invention, air is compressed by a compressor of known design (not shown) and is delivered to the pump 20 through a single compressed air line 60. This air is directed through a pressure line 61 to a compressed air header 62 as shown in FIGS. 2, 3 and 4. From this endless header 62, air is directed to compressed air inlet valves 65 for admission to the chambers 23, 24 and 25. By using this system, only a single compressed air line 60 is required; considerable expense in piping and hosing can be saved.

In furthering the invention, a vacuum of less than one atmosphere pressure is created, generated and maintained by the compressed air system. To accomplish this, air and other gasses from the chambers 23, 24 and 25 are drawn through vacuum valves 70 and up connector pipes 71 to an endless vacuum header 72. A collector vacuum line 73 leads from the header 72 to an air jet pump 74. A vacuum-creating stream of air is directed through a supply end 75 of this jet pump 74, and the vacuum-creating supply air and the gasses from the vacuum line 73 are together drawn down a jet pump exhaust line 76. This vacuum exhaust line 76 leads to the interior of the hollow kelly bar 16 for venting in an upward direction.

To minimize piping expense, the air supply for the jet pump 74 is provided by the compressed air inlet line 60 and a tee member 78 which connect the inlet air line 60 with the jet pump 74. The amount of vacuum provided is regulated by a valve 79 located between the tee member 78 and the air jet pump 74 itself.

To precisely position the pump 20 and cutter 30, and to prevent undesired pump motion in accordance with another aspect of the invention, the dredge pump is suspended and controlled as indicated in FIGS. 1 and 7. As illustrated, the kelly bar 16 is suspended from a cable 80. This kelly bar 16 is of a non-circular configuration; here, a hollow rectangular structure is provided. The kelly bar 16 extends vartically through a torque fork member 81 which is disposed in a generally horizontal position from a crane attachment 82 secured to the crane bottom 14. A stop member 83 at the distal end of the torque fork 81 prevents the kelly bar 16 from sliding out of engagement with the torque fork. In addition, this stop member 83 provides a connection to the torque fork cable 84; the torque fork cable 84 can be used to control the disposition of the torque fork 81.

As indicated particularly in FIG. 7, the torque fork 81 comprises a pair of members 86 and 87 which are so disposed as to closely embrace the kelly bar 16 and prevent kelly bar rotation. Since the kelly bar 16 is rigidly secured to the pump vessel 20 as by channel irons 88 (FIG. 3) rotational movement of the pump 20 is also consequently inhibited. Further, kelly bar 16 and pump chamber 20 movement in any direction except that extending parallel to the boom reach is also positively inhibited. Motion in the direction of boom reach can, of course, be easily controlled by a restraining cable suitably operated from the dredge control cab 13, or by retracting the reach of the boom 14 so as to bring the torque fork distal stop 83 into engagement with the kelly bar 16 or by other means. Thus, precise pump location can be provided, and movement of the pump during dredge operation can be carefully controlled. Indeed, in accordance with another aspect of the invention, pollution of surrounding waters is greatly minimized since cutter and material suction activity and location can be so precisely controlled.

Figure 8:
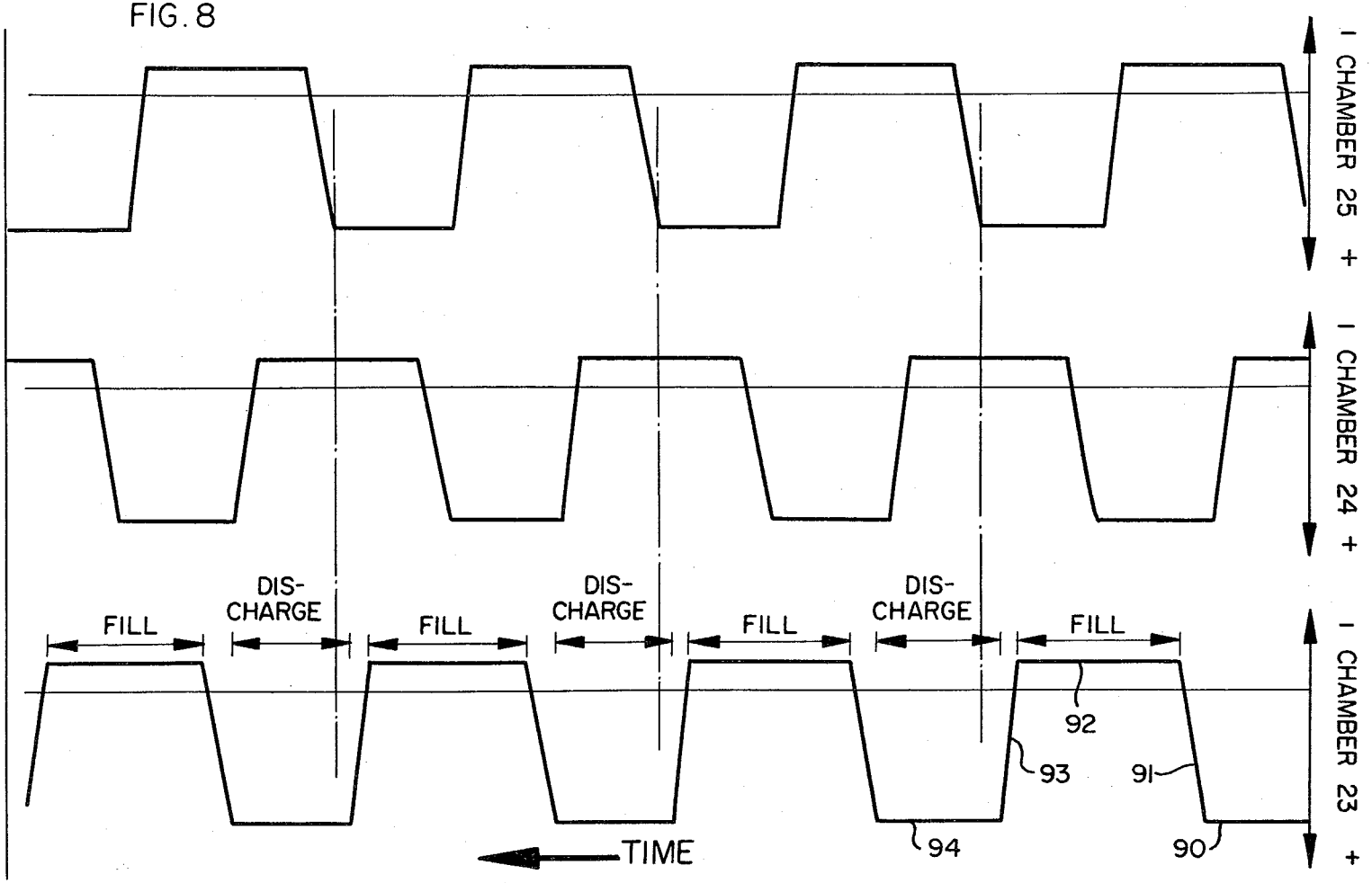
FIG. 8 is a chart showing pressures experienced within various pump chambers at various times and showing the staggered cyclic nature of pump operation.

The operation of the pump is represented in the chart of FIG. 8. As indicated there, a rough indication of the pressures experienced within each chamber 23, 24 and 25 is indicated in a horizontal direction across the top of the chart. Times are indicated in a vertical direction. Thus, for example, during the time represented by the line segment 90, chamber 23 is pressurized and is discharging dredge material. During the time represented by the line segment 91, the compressed air introduction valve has been closed and the vacuum valve has been opened and the pressure in that chamber 23 is being reduced to a slightly negative value. During this time, and the succeeding time indicated by the line segment 92, the chamber 23 is being filled with dredge material. During the time represented by the line segment 93, the vacuum valve has been closed and the compressed air valve has been opened so as to increase pressure within the chamber 23. During this time and the succeeding time represented by the line segment 94, dredge material is being discharged from the chamber 23. As illustrated, similar operating cycles occur in the remaining chambers.

It will also be noted that the operating cycle of each chamber 23, 24 and 25 is time staggered with respect to the other chambers. Thus, as the chart of FIG. 8 shows, the first chamber 23 can be fully pressurized and, consequently, can be undergoing expulsions of dredge material while the second chamber 24 is fully exhausted and is, consequently, filling with dredge material. At the same time, the pressure in the third chamber 25 can be undergoing reduction to a negative pressure or vacuum condition so as to encourage the suction of dredge material into that chamber. In this way, the relatively continuous flow of dredge material generated by the cutter 30 can be accommodated by the pump 20, and a relatively continuous, even flow of dredge material can be discharged from the pump. In addition, a relatively continuous flow of compressed air to the pump can be accommodated and efficiently used. Electrical circuitry using digital logic elements can be constructed by those skilled in the art to open and close the suction and vacuum valves as described above. Such valve operation will provide the described pumping and dredging action desired. A wide variety of materials can be dredge efficiently, and pollution in water adjacent the dredging site will be minimized or avoided.

The invention is claimed as follows:

1. A submersible dredging device, for moving high volumes of slurry-like materials having high proportions of solids, comprising a generally cylindrical vessel divided into at least three chambers by at least three radially disposed walls extending inwardly from the vessel side to a central, hollow core, each chamber defining an air port through which air can be delivered to and exhausted from the chamber, a material discharge port located near the chamber bottom for discharging liquid and solid material from the chamber, discharge port check valve means being associated with each chamber discharge port for prohibiting the return of discharged material to the chamber, each chamber having a material suction port for admitting liquid and solid material to the chamber, suction port check valve means for prohibiting the escape of material from the chamber through the suction port, and air control means for cyclicly exhausting air from each chamber to admit material to the chamber through the suction port and for delivering air to the chamber to discharge material from the chamber through the discharge port, air control means including header reservoir compressed air delivery means for quickly delivering a surplus of compressed air to each chamber, and air control valve means located adjacent the chamber, vacuum creating means for reducing air pressure inside each chamber to less than one atmosphere, header reservoir means interconnecting said vacuum creating means and each of said chambers for quickly supplying a surplus of vacuum to each chamber, and vacuum control valve means located adjacent the chamber, a rotatable low turbidity feeding mechanism for acquiring material to be dredged, motor means located below the vessel and connected to the feeding mechanism for rotating the feeding mechanism, motor control cable means extending through the vessel core to the motor means and conduit means extending from the cutter to the chamber suction port for delivering material from the cutter to the chamber.

2. A dredging device according to claim 1 wherein said vacuum creating means includes jet pump means connected to a compressed air source.

3. A dredging device according to claim 1 further including high level sensor means carried on and in the chamber and connected to said air control means for initiating delivery of air to the chamber and consequently beginning discharge of material from the chamber when a pre-selected high level of material in the chamber is reached.

4. A dredging device according to claim 1 further including low level sensor means and carried on and in the chamber and connected to said air control means for halting delivery of air to the chamber when a pre-selected low level of material in the chamber is reached.

5. A dredging device according to claim 1 including a kelly bar attached to and extending from said chamber, and including torque fork means engaging the kelly bar to inhibit rotation of the kelly bar and chamber during chamber operation.

6. A dredging device according to claim 5 wherein said kelly bar is hollow, and wherein said air control means is connected to the interior of the hollow kelly bar whereby to vent air from the chamber up the kelly bar interior.

7. A dredging device according to claim 6 wherein said air control means includes means for causing the cyclic exhaustion and delivery of air to and from each chamber to occur in time staggered sequence with respect to the other chambers, whereby to efficiently use the air delivered to and exhausted from each chamber and to provide a relatively uniform flow of material from the vessel.

8. A dredging device according to claim 7 wherein said vacuum creating means includes jet pump means connected to a compressed air source.

9. A dredging device according to claim 7 further including sensor means carried on and in the chamber and connected to said air control means for initiating delivery of air to the chamber and consequently beginning discharge of material from the chamber when a pre-selected level of material in the chamber is reached.

10. A dredging device, for moving high volumes of slurry-like materials having high proportions of solids, comprising hollow kelly bar means, a generally cylindrical vessel divided into at least three chambers by at least three radially disposed walls extending inwardly from the vessel side to a central, hollow core, the vessel being suspended from the kelly bar means with the hollow core being in communication with the hollow kelly bar means, each vessel chamber defining an air port through which air can be delivered to and exhausted from the chamber, a material discharge port located near the chamber bottom for discharging liquid and solid material from the chamber, discharge port check valve means being associated with the discharge port for prohibiting the return of discharged material to the chamber, a material suction port for admitting liquid and solid material to the chamber, suction port check valve means for prohibiting the escape of material from the chamber through the suction port, the dredging device further comprising air control means for cyclicly exhausting air from the chamber to admit material to the chamber through the suction port, and for delivering air to the chamber to discharge material from the chamber through the discharge port, the air control means including a supply of compressed air, air header means for delivering an excess of compressed air to each chamber upon demand, a vacuum supply, vacuum header means for delivering an excess of vacuum to each chamber upon demand, and valve means adjacent to each chamber for controlling the delivery of air and vacuum to each chamber, the device further comprising torque fork means for engaging the kelly bar to inhibit rotation of the kelly bar and vessel during vessel operations.

11. A dredging device according to claim 10 wherein said kelly bar means is non-circular in configuration and wherein said torque fork means includes at least one member disposed closely adjacent the kelly bar to inhibit kelly bar and chamber movement during chamber operation.

12. A dredging device according to claim 10 wherein said air control means is connected to the interior of the hollow kelly bar whereby to vent air from the chamber up the kelly bar interior.

* * * * *